United States Patent [19]

Iwahara et al.

[11] Patent Number: 4,696,043

[45] Date of Patent: Sep. 22, 1987

[54] MICROPHONE APPARATUS HAVING A VARIABLE DIRECTIVITY PATTERN

[75] Inventors: Makoto Iwahara, Sagamihara; Naotaka Miyaji, Yamato; Atsushi Sakamoto, Sagamihara, all of Japan

[73] Assignee: Victor Company of Japan, Ltd., Japan

[21] Appl. No.: 766,280

[22] Filed: Aug. 16, 1985

[30] Foreign Application Priority Data

Aug. 24, 1984 [JP] Japan ..... 59-176288
Aug. 29, 1984 [JP] Japan ..... 59-130756[U]

[51] Int. Cl.[4] ..... H04R 1/40

[52] U.S. Cl. ..... 381/92; 381/122; 381/155; 381/168

[58] Field of Search ..... 381/92, 98, 122, 155, 381/168; 179/121 R, 121 D

[56] References Cited

U.S. PATENT DOCUMENTS 4,130,726 12/1978 Kates et al. ..... 381/98
4,521,908 6/1985 Miyaji et al. ..... 381/92
4,536,887 8/1985 Kaneda et al. ..... 381/92

FOREIGN PATENT DOCUMENTS 58-130695 8/1983 Japan ..... 381/98
59-171297 9/1984 Japan ..... 381/92
60-90499 5/1985 Japan ..... 381/92

*Primary Examiner*—Gene Z. Rubinson
*Assistant Examiner*—Danita R. Byrd
*Attorney, Agent, or Firm*—Lowe, Price, Leblanc, Becker & Shur

[57] ABSTRACT

A microphone apparatus includes an array of equally spaced microphones divided into a center subarray and a pair of side subarrays located one on each side of the center subarray. A first weighting network having a plurality of weighting factors impresses a first weighting function on signals from the center subarray. Second and third weighting networks each having a plurality of weighting factors impress second and third weighting functions respectively on signals from the side subarrays. The first, second and third weighting functions correspond respectively to center and side portions of a total function. Signals from the first weighting network are summed in a first adder, signals from the second and third weighting networks being summed in a second adder and cmbined with the output of the first adder in a third adder to produce an output signal. A variable directivity pattern is obtained by a level setting means which allows adjustment of the level of the output signal from the second adder in a predetermined relationship with the level of the output signal from the first adder.

20 Claims, 21 Drawing Figures

5 kHz

MICROPHONE APPARATUS HAVING A VARIABLE DIRECTIVITY PATTERN

BACKGROUND OF THE INVENTION

The present invention relates to a microphone apparatus, and more specifically to a microphone apparatus having a variable directivity pattern.

It is known to contruct a microphone having a variable directivity pattern. However, because of the inherent difficulty to realize sharpness on a single microphone, the variable range of such single-unit microphones has been severely limited. An apparatus having a wider range of variable directivity patterns has therefore been desired.

SUMMARY OF THE INVENTION

It is, therefore, an object of the present invention to provide a microphone apparatus having a greater range of variable directivity patterns.

According to the present invention, the microphone apparatus comprises an array of equally spaced microphones, the microphones being divided into a center subarray and a pair of side subarrays located one on each side of the center subarray. A first weighting network having a plurality of weighting factors is provided for impressing a first weighting function on signals from the microphones of the center subarray. Second and third weighting networks each having a plurality of weighting factors impress second and third weighting functions respectively on signals from the microphones of the side subarrays. The first, second and third weighting functions correspond respectively to center and side portions of a total function. Signals from the first weighting network are summed in a first adder and signals from the second and third weighting networks are summed in a second adder. A third adder combines the signals from the first and second adders to produce an output signal. A variable directivity pattern is obtained by a level setting means which allows adjustment of the level of the output signal from the second adder in a predetermined relationship with the level of the output signal from the first adder.

Zooming sound effect is obtained if the output of the first adder undergoes minimum attenuation or is passed through a second level adjusting means which is varied from a low-level setting to a higher-level setting, while the first level setting means is varied from a zero-level setting to the higher-level setting. Such acoustic zooming effect is advantageous if the image of the sound source is zoomed on a television screen.

To suppress undesirable sidelobes generated at high frequencies in broad-angle modes, the first weighting network preferably comprises a first part for impressing a first-part weighting function on signals from the microphones of the center subarray and applying the impressed signals to the first adder, and a second part for impressing a second-part weighting function on said signals from the center subarray microphones and applying the impressed signals to said second adder. The first-part weighting function is analogous to the convexed total function, and the second-part weighting function being complementary to said first-part weighting function.

BRIEF DESCRIPTION OF THE DRAWINGS

The present invention will be described in further detail with reference to the accompanying drawings, in which.

DETAILED DESCRIPTION

Figure 1:
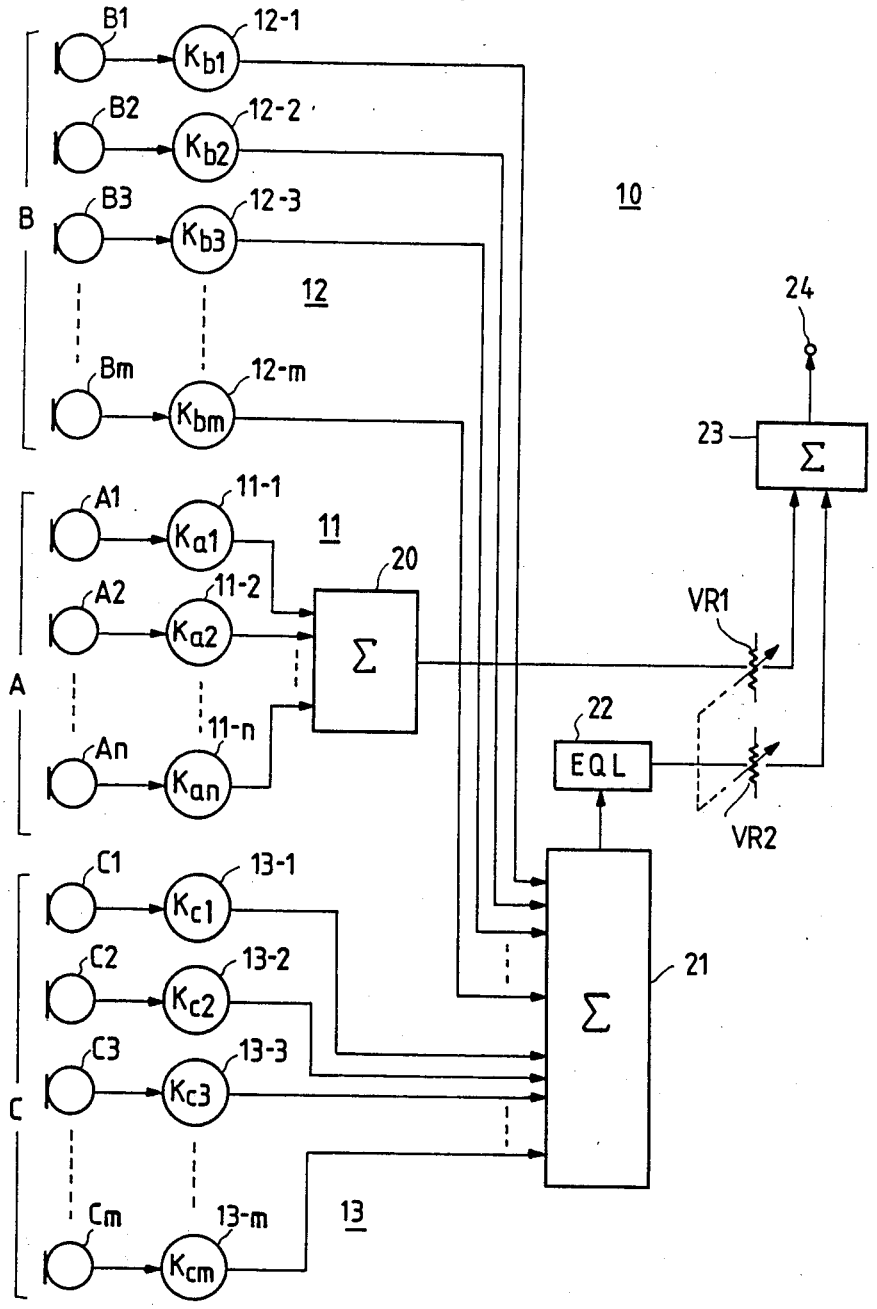
FIG. 1 is a block diagram of a first embodiment of the microphone apparatus of the invention.

FIG. 1 shows a preferred embodiment of a microphone apparatus 10 in accordance with the present invention. Microphone apparatus 10 comprises a linear array of equally spaced microphones divided into three groups. The first group or subarray A comprises microphones A1 to An which are located in the center portion of the array. The second subarray B comprises microphones B1 to Bm which are located on one side of the center subarray A and the third subarray C comprises microphones C1 to Cn located on the other side of the center subarray A. The microphones may be of the omnidirectional type, but preferably each has a directivity pattern as described by a cardioid or hypercardioid curve. If directional microphones are employed, the directivity of each microphone is preferably pointed in a direction perpendicular to the length of the microphone array.

Figure 2:
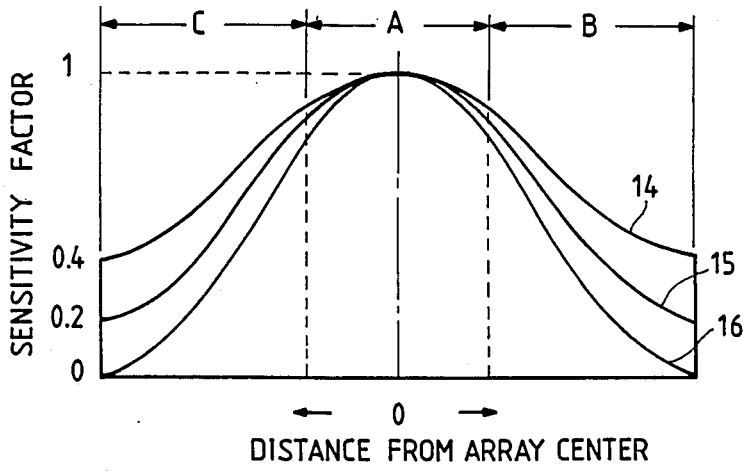
FIG. 2 is an illustration of Hamming and Hanning windows to be impressed on signals from the microphones.

Output signals from the center microphones A1 to An are respectively fed to weighting elements 11-1 to 11-n of a center weighting network 11, output signals from the side microphones B1 to Bm being fed to weighting elements 12-1 to 12-m of a side weighting network 12. Likewise, output signals from the side microphones C1 to Cm are respectively applied to weighting elements 13-1 to 13-m of a side weighting network 13. The individual weighting elements of each weighting network have a particular weighting function to impress it on the outputs of the microphones of the associated subarrays. It is preferred to impress a weighting function known as "Hamming window" so that for a given input acoustic energy level the outputs of weighting elements of the networks 11, 12 and 13 describe one of two curves 14 and 15 shown in FIG. 2. Each of the Hamming window curves slopes downward symmetrically from its center at a rate determined by the particular Hamming window function and terminates at a sensitivity factor. Thus, the weighting factors $Ka_1$ to $Ka_n$ of elements 11-1 to 11-n modify the output signals of the center microphones A1 to An to form the center portion of the Hamming window 14, for example, and the weighting factors $Kb_1$ to $Kb_m$ of the elements 12-1 to 12-m modify the output signals of the side microphones B1 to Bm to impress the right-side portion of the Hamming window 14. Likewise, the weighting factors $Kc_1$ to $Kc_m$ of the elements 13-1 to 13-m modify the outputs of the side microphones C1 to Cm to impress the left-side portion of the Hamming window 14.

Figure 3:
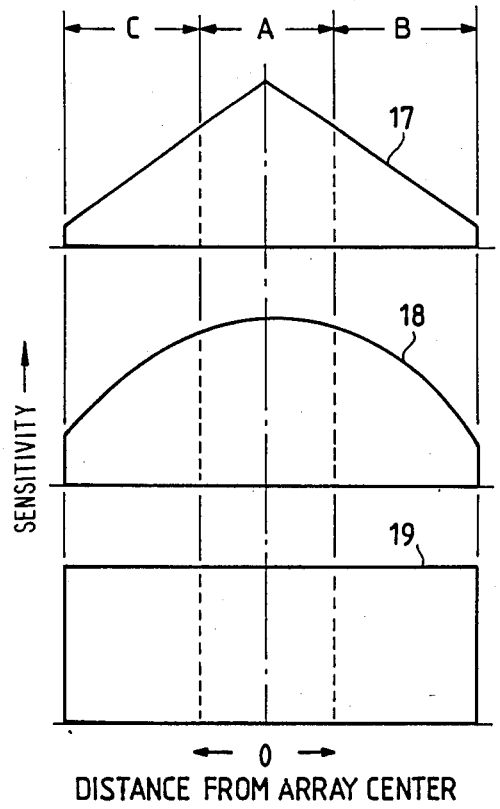
FIG. 3 is an illustration of other weighting functions useful for the present invention.
Figure 5:
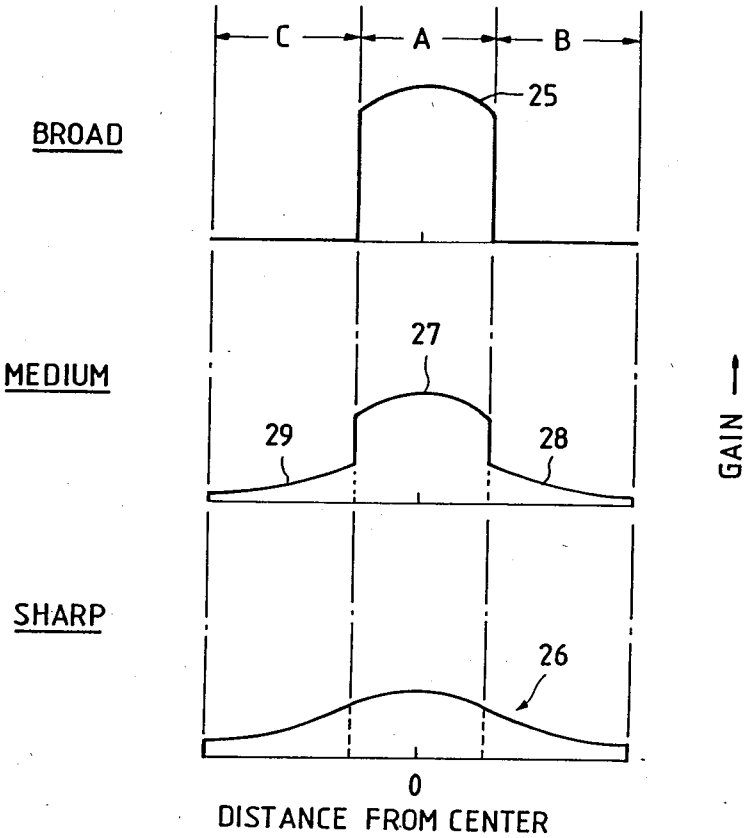
FIG. 5 is an illustration of weighting functions varying as a function of the settings of the variable resistors according to FIG. 4.

Depending on applications in which reduced sidelobes with moderate sensitivities are desired, the sensitivity factor of the Hamming window may be selected from the range between 0 and 0.7 (in the case of sensitivity factor 0, curve 16 or "Hanning window" is adopted). From the practical point of view, a triangular configuration 17, FIG. 3, is also useful. A semi-circular configuration 18 can also be used. In cases where sensitivity is most important, a rectangular configuration 19 ("rectangular window") could be employed.

The individually weighted microphone outputs from the center weighting network 11 are combined together in a summing amplifier or adder 20 and coupled through a variable resistor VR1 to a first input of an adder 23. Likewise, the individually the weighted microphone outputs from the side weighting networks 11 and 13 are combined in an adder 21 and passed to a frequency equalizer 22 having a function which will be described later. The output of equalizer 22 is applied through a second variable resistor VR2 to the second input of adder 23. The purpose of the variable resistors VR1 and VR2 is to uniformly modify the level of the combined center microphone output from adder 20 in relation to the level of the combined side microphone output from adder 21 to produce variable focusing effect on the apparatus 10. For this purpose, variable resistors VR1 and VR2 are ganged together in a predetermined relationship. The combined outputs from adders 20 and 21 are summed in the adder 23 and fed to an output terminal 24.

Figure 4:
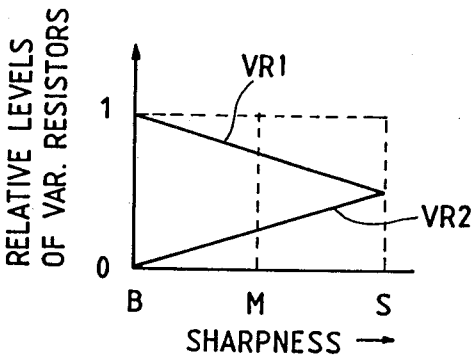
FIG. 4 is a graphic illustration of a relationship between the settings of the variable resistors of FIG. 1.
Figure 7:
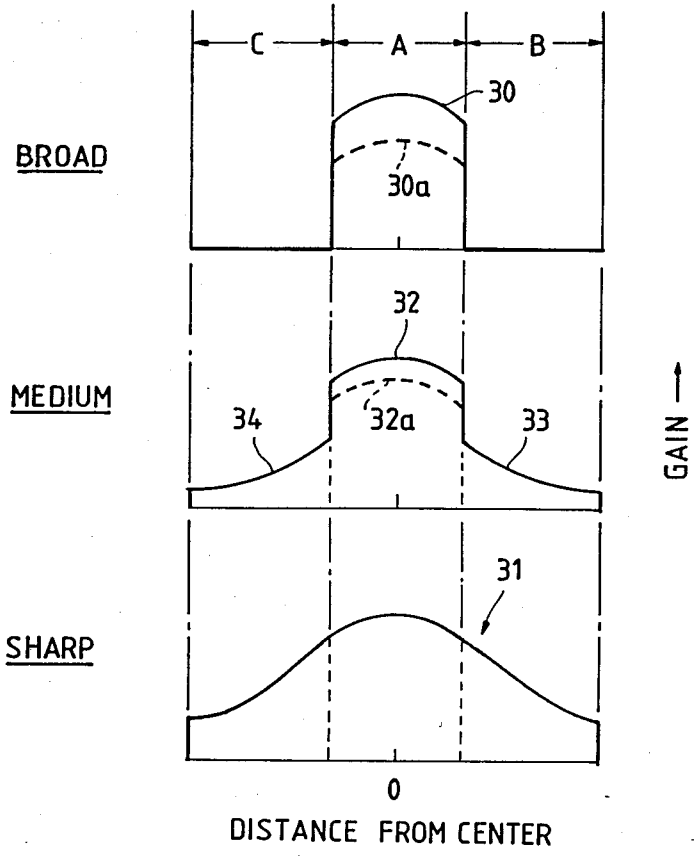
FIG. 7 is an illustration of weighting functions varying as a function of the level settings according to FIG. 6.

Variable resistors VR1 and VR2 are intercoupled to vary their output levels as shown in FIGS. 4 to 8. In one example, variable resistors VR1 and VR2 are ganged so that for a given level of signals applied to resistors VR1 and VR2 their output signals vary complementarily with each other in the broad-to-sharp focus scale as illustrated in FIG. 4. Specifically, when the output of resistor VR1 is at the highest value the output of resistor VR2 is at the lowest, or zero value. In this instance the signal at the output terminal 24 is derived exclusively from the center microphone signals which describe a function 25 (FIG. 5) corresponding to the center portion of the Hamming window. The angle of sensitivity range of the apparatus 10 is broad, so that it can detect sound coming from every source on a theater stage, for example.

The sharpness of the microphone apparatus 10 increases as the point is moved toward the sharpness end of the scale until equal setting is reached. When this occurs, the weighted center and side microphone signals describe a function 26 corresponding to the total of the Hamming window with the highest gain being lower than the highest gain of the function 25. The effect of this sharp setting is to enable only the sound coming from the center area of the stage to be detected. If these variable resistors are adjusted at midpoint on the scale, a medium value of sharpness can be obtained. In that instance, the center microphone signals describe a function 27 having a highest gain intermediate the highest gains of functions 25 and 26, and the right- and left-side microphone signals describe functions 28 and 29 each having a highest gain lower than the highest gain of the corresponding part of the function 26.

Figure 6:
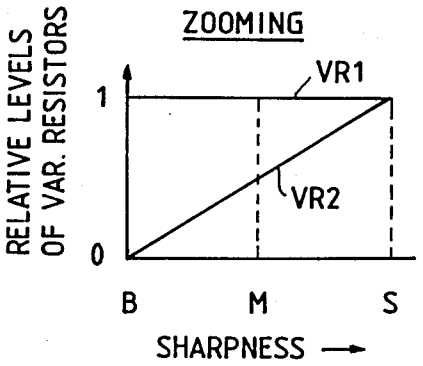
FIG. 6 is a graphic illustration of another relationship between the settings of the variable resistors.

Zooming sound effect can be obtained by making the variable resistors VR1 and VR2 interrelated as shown in FIG. 6. In this embodiment, for a given level of input signals applied to the variable resistors the variable resistor VR1 is held at a constant maximum level throughout the broad-to-sharpness scale, while the variable resistor VR2 varies linearly from minimum, or zero value to the maximum level. At the broad end of the scale, the output of resistor VR2 is zero, the weighted center microphone signals, which describe a function 30 (FIG. 7), are only allowed to appear at the output terminal 24. At the sharp end of the scale, the center and side microphone signals undergo minimum attenuation and describe a function 31 identical to the original Hamming window impressed upon them by weighting networks 11, 12 and 13. When the sensitivity angle is narrowed as the point on the scale is moved to its sharp end, the total energy of the signal at the output terminal 24 increases. This will give an acoustophysiological impression to television viewers that sound source or sources detected in the progressively narrowing range would come closer to the viewers if the image of the detected sound sources is zoomed on the television screen. At medium level setting, the center microphone signals describe a function 32 and the side microphone signals describe functions 33 and 34.

Figure 8:
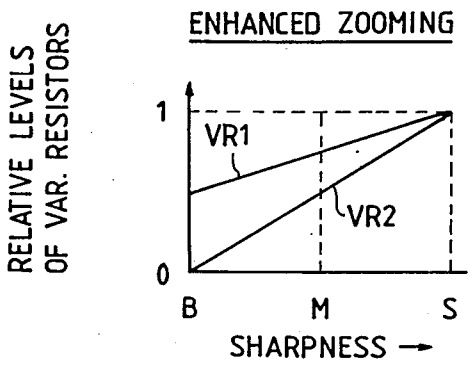
FIG. 8 is a graphic illustration of a further relationship between the level settings of the variable resistors.

Enhanced zooming effect can be achieved by modifying the interrelation of FIG. 6 so that the variable resistor VR1 varies from an intermediate level anywhere between maximum and minimum values at the broad end of the scale linearly to the maximum level, as shown in FIG. 8. In this case, the center microphone signals describe a function 30*a* having lower gains that the function 30. With medium level setting, the center microphone signals describe a function 32*a* which is lower than function 32.

Figure 9:
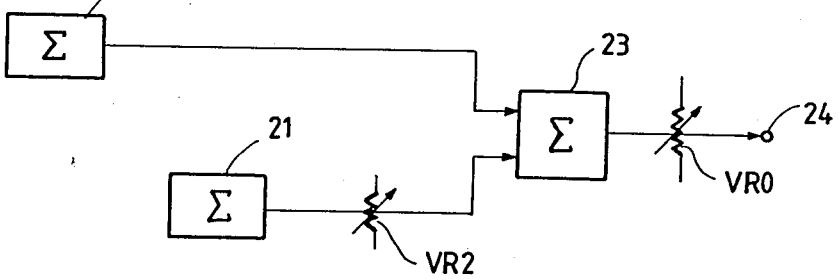
FIG. 9 is an illustration of a modified form of the embodiment of FIG. 1.
Figures 10A, 10B, 10C:
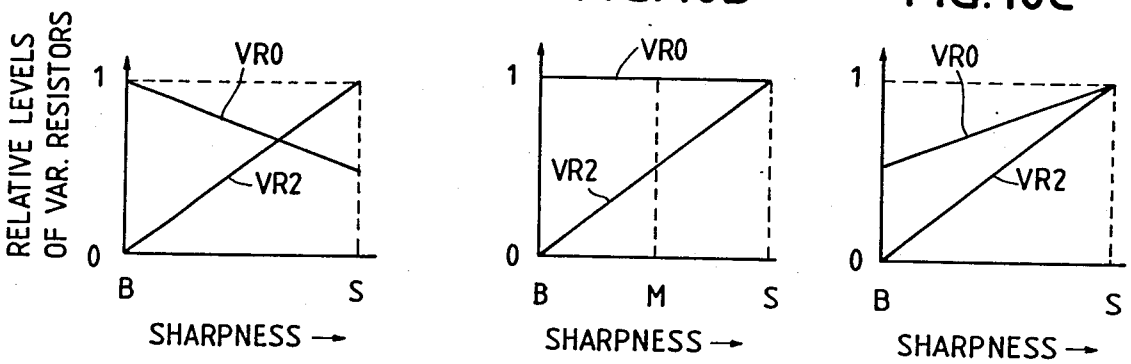
FIGS. 10A, 10B and 10C are graphic illustrations of relationships between the level settings of the variable resistors FIG. 9.

The location of the variable resistors VR1 and VR2 may be altered as shown in FIG. 9. In this example, the variable resistor designated VR0 is connected to the output of the adder 23. The sensitivity angle of apparatus 10 can be varied by interrelating the settings of the variable resistors VRO and VR2 as illustrated in FIGS. 10A, 10B and 10C. The interrelation shown in FIG. 10A corresponds to that shown in FIG. 4, and those of FIGS. 10B and 10C correspond respectively to those of FIGS. 6 and 8.

Figure 11:
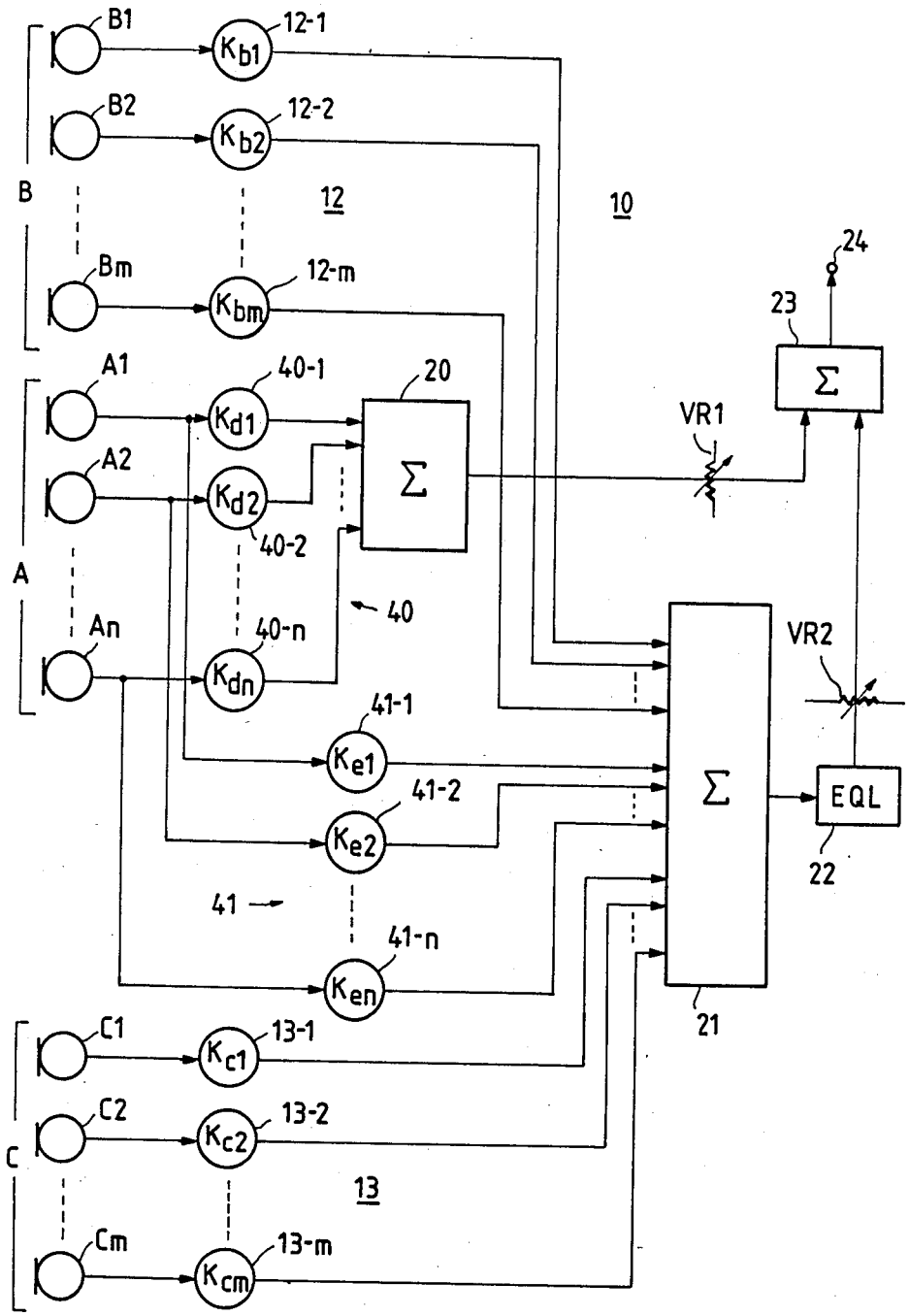
FIG. 11 is a block diagram of a second embodiment of the invention.

FIG. 11 is a modification of the embodiment of FIG. 1. The modification differs from the previous embodiment in that first and second weighting networks 40 and 41 are provided for impressing complementary Hamming window functions on signals from the center microphones. The first weighting network 40 includes individual weighting elements 40-1 to 40-n having weighting factors $Kd_1$ to $Kd_n$ and the second weighting network 41 includes individual weighting elements 41-1 to 41-n having weighting factors $Ke_1$ to $Ke_n$ corresponding to the weighting factors $Kd_l$ to $Kd_n$, respectively. The outputs of the center microphones A1 to An are coupled through the weighting elements 40-1 to 40-n, respectively, to the adder 20 and are further coupled through the weighting elements 41-1 to 41-n, respectively, to the adder 21.

Figure 12:
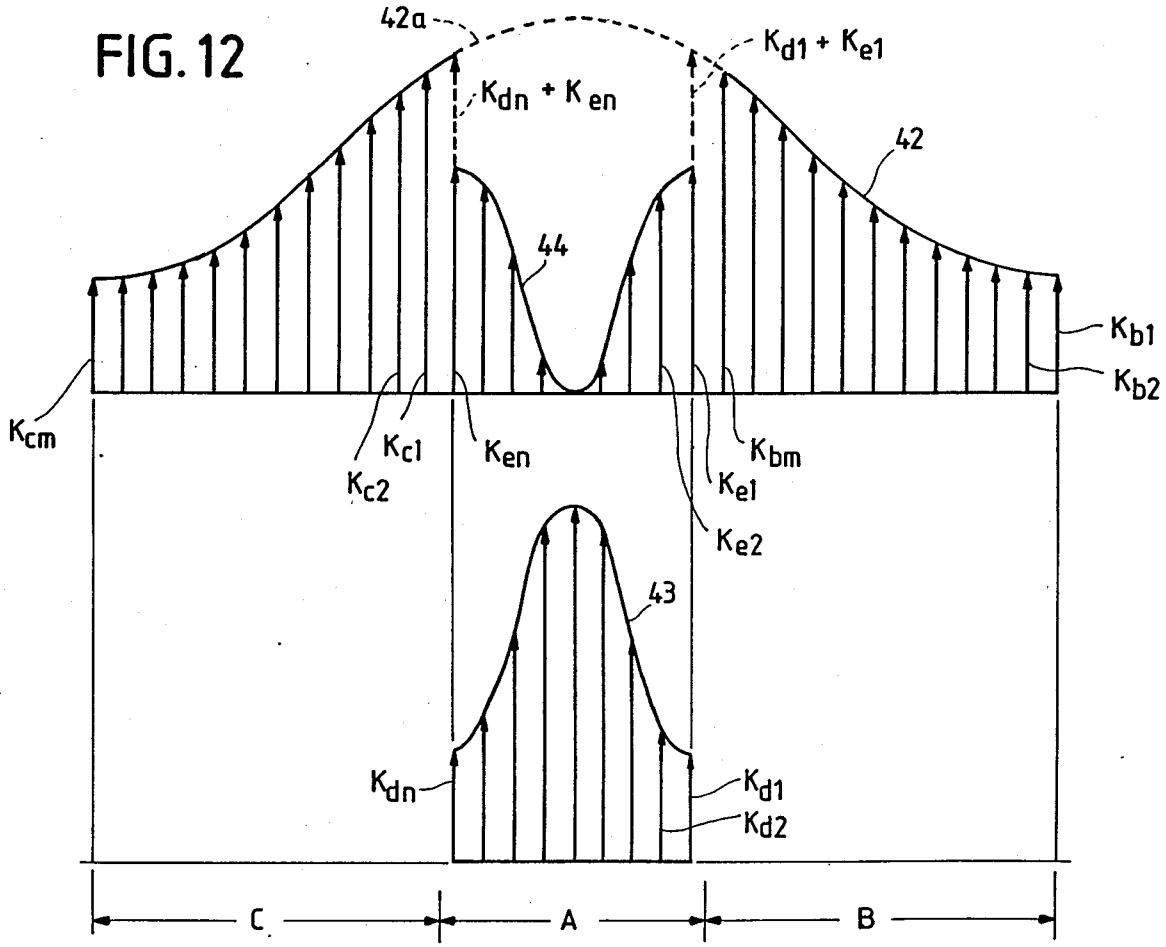
FIG. 12 is an illustration of weighting functions impressed on signals from the center and side microphones of FIG. 11.

As illustrated in FIG. 12, the weighting networks 12 and 13 impress the side portions of a Hamming window 42 on signals from the side microphone subarrays B and C. Weighting factors $Kd_1$ through $Kd_n$ of the first weighting network 40 describe a Hamming window 43 which is analogous to the total Hamming window 42. Weighting factors $Ke_1$ through $Ke_n$ of the second weighting network 41 describe a function 44 which is complementary to the Hamming window 42 such that when the combined values of the weighting factors Kd of the first network 40 and the corresponding weighting factors Ke of the second network 41 describe a function which constitutes the center portion of the Hamming window 42 as indicated by a dotted-line curve 42*a*.

Figure 13:
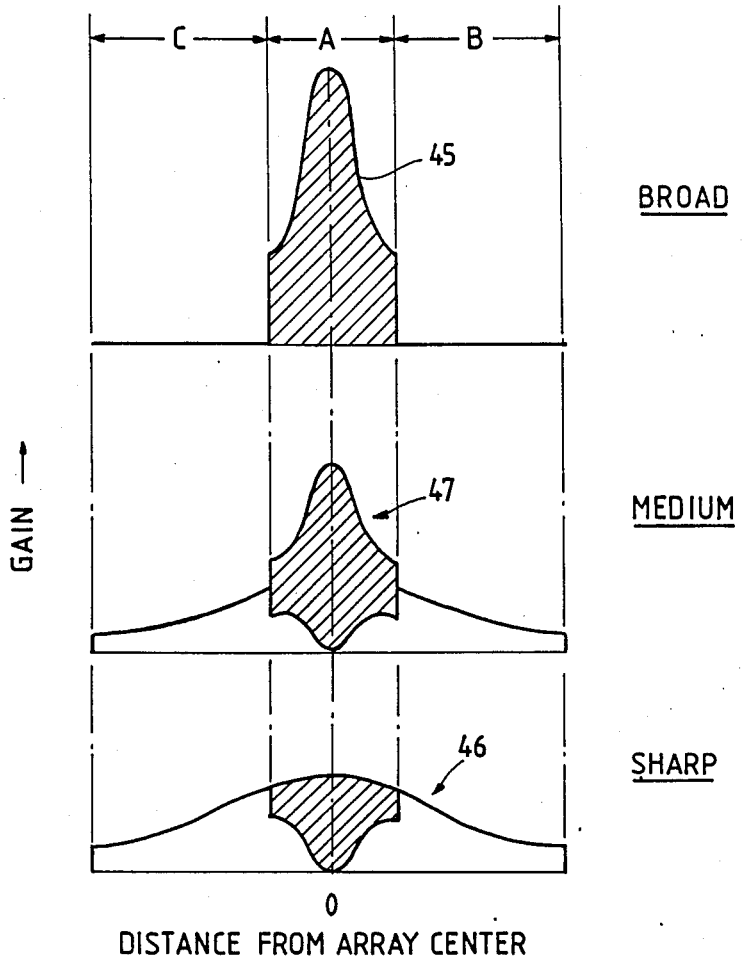
FIG. 13 is an illustration of weighting functions varying as a function of the level settings of the variable resistors of FIG. 11 according to FIG. 4.

If the variable resistors VR1 and VR2 are interrelated as shown in FIG. 4, the center microphone signals will describe a Hamming window curve 45 (FIG. 13) when the setting of the variable resistors VR1 and VR2 is at the broad end of the scale and all the microphone outputs will describe a Hamming window curve 46 when the setting is at the sharp end of the scale. Medium setting on the variable resistors will produce a curve 47.

The impression of the Hamming window on the center microphone outputs has the effect of suppressing undesirable sidelobes which would otherwise occur in the high frequency range of the audio spectrum when the variable resistor setting is at the broad end of the scale.

While mention is made of a Hamming window, the weighing factors employed in the FIG. 11 embodiment may describe another form of window function such as Hanning or triangular.

Figure 14A:
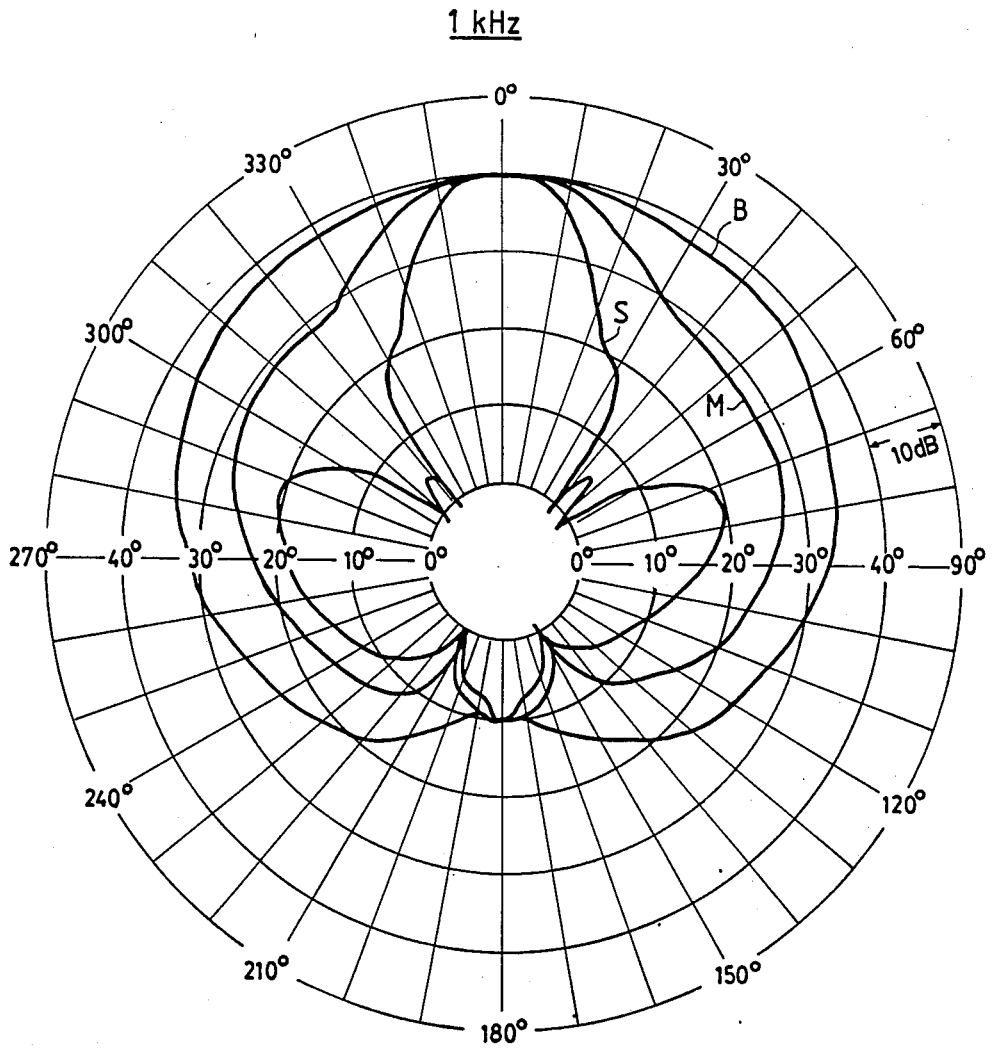
FIGS. 14A and 14B are illustrations of directivity patterns obtained with the apparatus of FIG. 11.
Figure 14B:
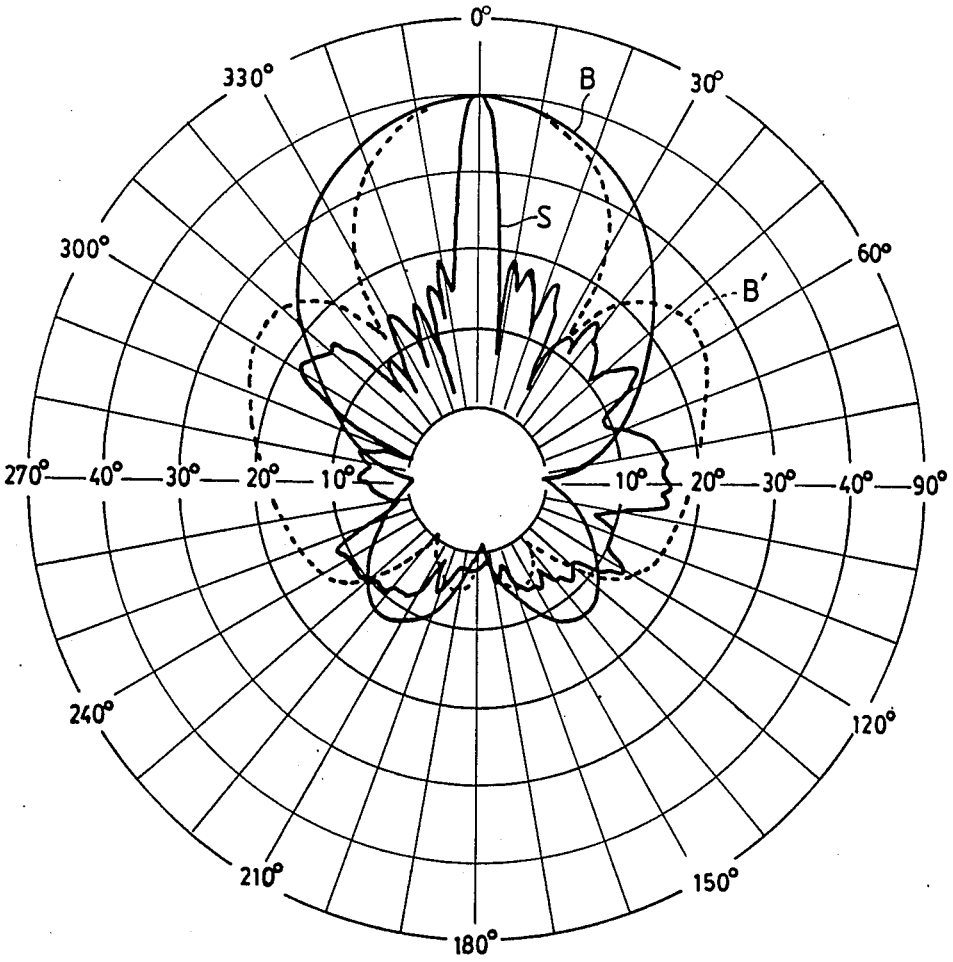

FIG. 14A illustrates 1-kHz directivity patterns of the apparatus 10 of FIG. 11 in which eighty-one microphones of the cardioid type are arranged at a spacing of 14.2 mm, with seven of which are located on the center of the array as center microphones and two sets of thirty-seven microphones are arranged one on each side of the center microphones. Curves B, M and S respectively illustrate the directivity patterns obtained by broad, medium and sharp settings according to FIG. 4. FIG. 14B illustrates 5-kHz directivity patterns of the same apparatus at broad and sharp settings. A broad directivity pattern is also obtained by the apparatus of FIG. 1 and shown by a dotted-line curve B′ for purposes of comparison. As illustrated, this directivity pattern has undesirable sidelobe components which can be eliminated by the impression of the convexed weighting function on the center microphone signals which weighting function would produce a convexed total weighting function when combined with the weighting function described by the side microphone signals.

Figure 15:
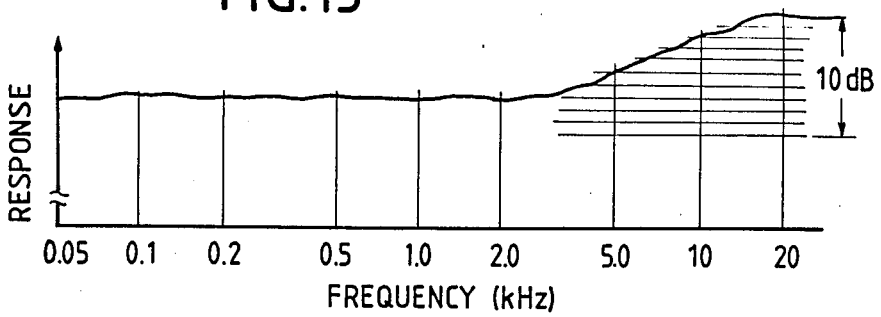
FIG. 15 is an illustration of the frequency response of the equalizer of FIGS. 1 and 11.
Figure 16:
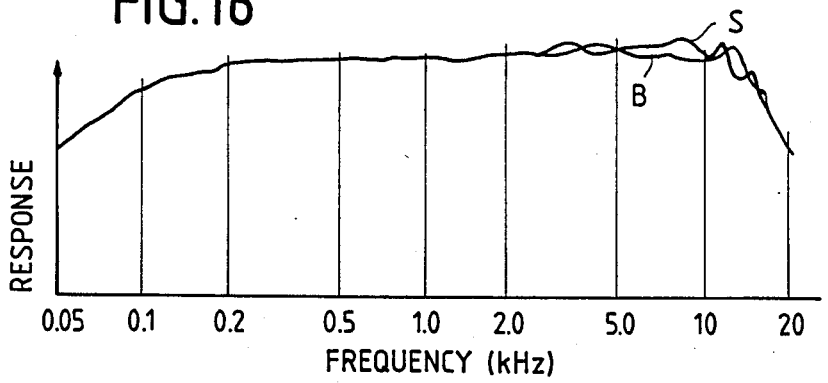
FIG. 16 is a graphic illustration of the frequency response of the apparatus of FIGS. 1 and 11.
Figure 17:
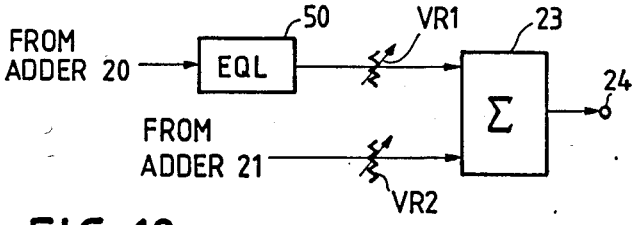
FIG. 17 is a block diagram of an alternative form of the invention.
Figure 18:
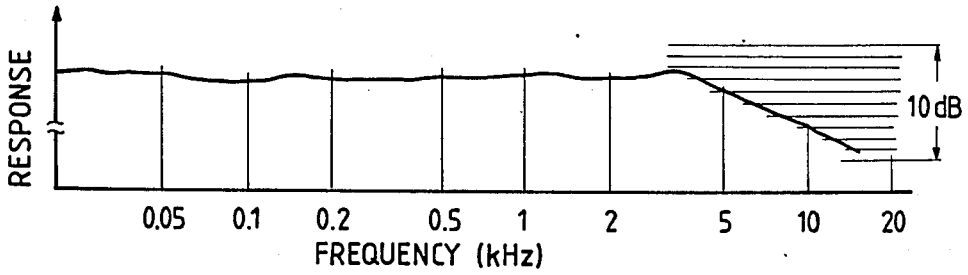
FIG. 18 is an illustration of the frequency response of the equalizer of FIG. 17.

Owing to the fact that the individual microphones have different high-range frequency responses the combined high-range response of apparatus 10 obtained with sharp-angle setting is lower than is obtained with broad-angle setting. The purpose of the frequency equalizer 22 provided in the embodiments of FIGS. 1 and 11 is to equalize the high-range responses at sharp and broad settings and provide a flat response characteristic over the audio spectrum. FIG. 15 is an illustration of the frequency response of the equalizer 22. As illustrated, the equalizer 22 emphasizes signals higher than 5 kHz. The provision of the equalizer 22 in the output of adder 21 enhances the high-range response of the signals which contribute to the sharpness of apparatus 10 with respect to the signals that contribute to the broadness of apparatus 10, and results in the apparatus 10 having a response shown in FIG. 16. As respectively indicated by characters B and S, the high-range responses of apparatus at broad- and sharp-settings are substantially equalized. Alternatively, an equalizer 50 may be connected to the output of adder 20 as shown in FIG. 17. This equalizer has a high-range response (see FIG. 18) sloping in a direction opposite to the high-range characteristic of equalizer 22.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A microphone apparatus comprising:

an array of equally spaced microphones, the microphones being divided into a center subarray and a pair of side subarrays located one on each side of the center subarray;

a first weighting network having a plurality of weighting factors for impressing a first weighting function on signals from the microphones of the center subarray.

second and third weighting networks each having a plurality of weighting factors for impressing second and third weighting functions respectively on signals from the microphones of said side subarrays, said first, second and third weighting functions corresponding respectively to center and side portions of a sensitivity profile which varies as a function of positions on said array;

a first adder for summing signals from said first weighting network;

a second adder for summing signals from said second and third weighting networks;

a third adder for summing signals from said first and second adders to produce an output signal; and level setting means for adjusting the level of an output signal from said second adder in a predetermined relationship with the level of an output signal from said first adder to provide a variable directivity pattern.

2. A microphone apparatus as claimed in claim 1, wherein said sensitivity profile is a rectangular window.

3. A microphone apparatus as claimed in claim 1, wherein said sensitivity profile is a convexed curve.

4. A microphone apparatus as claimed in claim 3, wherein said convexed curve is a Hamming window.

5. A microphone apparatus as claimed in claim 3, wherein said convexed curve is a Hanning window.

6. A microphone apparatus as claimed in claim 3, wherein said convexed curve is a triangular window.

7. A microphone apparatus as claimed in claim 1, further comprising second level setting means for adjusting the level of an output signal from said first adder in a predetermined relationship with the setting of the first-mentioned level setting means.

8. A microphone apparatus as claimed in claim 7, wherein said first and second level setting means are adjustable complementarily with each other.

9. A microphone apparatus as claimed in claim 7, wherein said first level setting means is variable in a range between a lower-level setting and a higher-level setting and said second level setting means is variable in a range between zero-level setting and said higher-level setting.

10. A microphone apparatus as claimed in claim 3, wherein said first weighting network comprises:

a first part for impressing a first-part weighting function on signals from the microphones of the center subarray and applying the impressed signals to said first adder, said first-part weighting function being analogous to the convexed sensitivity profile; and a second part for impressing a second-part weighting function on said signals from the center subarray microphones and applying the impressed signals to said second adder, said second-part weighting function being complementary to said first-part weighting function.

11. A microphone apparatus as claimed in claim 10, wherein said first-part weighting function is a Hamming window.

12. A microphone apparatus as claimed in claim 10, wherein said first-part weighting function is a Hanning window.

13. A microphone apparatus as claimed in claim 10, further comprising second level setting means for adjusting the level of an output signal from said first adder in a predetermined relationship with the setting of the first-mentioned level setting means.

14. A microphone apparatus as claimed in claim 13, wherein said first and second level setting means are adjustable complementarily with each other.

15. A microphone apparatus as claimed in claim 13, wherein said first level setting means is variable in a range between a lower-level setting and a higher-level setting and said second level setting means is variable in a range between zero-level setting and said higher-level setting.

16. A microphone apparatus as claimed in claim 1, further comprising a frequency equalizer for equalizing high-range response characteristics of the output signals of said first and second adders.

17. A microphone apparatus as claimed in claim 10, further comprising a frequency equalizer for equalizing high-range response characteristics of the output signals of said first and second adders.

18. A microphone apparatus as claimed in claim 1, wherein each microphone of said array has a unidirectional sensitivity.

19. A microphone apparatus as claimed in claim 10, wherein each microphone of said array has a unidirectionl sensitivity.

20. A microphone apparatus as claimed in claim 10, wherein said center subarray includes at least three microphones.

* * * * *